US006065870A

United States Patent [19]

Nunez

[11] Patent Number: 6,065,870

[45] Date of Patent: May 23, 2000

[54] INFLATABLE LUGGAGE INSERT

[76] Inventor: Luis Alberto Nunez, P.O. Box 8G, Birri, Barva, Heredia 3011, Costa Rica

[21] Appl. No.: 09/220,940

[22] Filed: Dec. 24, 1998

[51] Int. Cl.[7] ..... B65D 30/24

[52] U.S. Cl. ..... 383/3; 383/11; 206/522

[58] Field of Search ..... 206/522; 383/3, 383/11

[56] References Cited

U.S. PATENT DOCUMENTS

| | | | |
|---|---|---|---|
| 4,145,973 | 3/1979 | Baxter | 206/522 X |
| 4,569,082 | 2/1986 | Ainsworth et al. | 206/522 X |
| 4,573,202 | 2/1986 | Lee | 206/522 X |
| 4,801,213 | 1/1989 | Frey et al. | 206/522 X |
| 5,454,642 | 10/1995 | De Luca | 206/522 X |
| 5,622,262 | 4/1997 | Sadow | 206/522 |
| 5,996,798 | 12/1999 | Gessert | 206/522 X |

FOREIGN PATENT DOCUMENTS

| | | | |
|---|---|---|---|
| 4314205 | 11/1994 | Germany | 206/522 |

*Primary Examiner*—Jes F. Pascua

[57] ABSTRACT

A cargo constraining device for a piece of luggage is provided including at least one bladder having a periphery which encompasses an area approximately equal to one of a pair of faces of the piece of luggage. A valve is mounted on the bladder for selectively inflating the same.

3 Claims, 3 Drawing Sheets

INFLATABLE LUGGAGE INSERT

BACKGROUND OF THE INVENTION

1. Field of the Invention

The present invention relates to padded luggage and more particularly pertains to a new inflatable luggage insert for preventing items within a piece of luggage from shifting during travel.

2. Description of the Prior Art

The use of padded luggage is known in the prior art. More specifically, padded luggage heretofore devised and utilized are known to consist basically of familiar, expected and obvious structural configurations, notwithstanding the myriad of designs encompassed by the crowded prior art which have been developed for the fulfillment of countless objectives and requirements.

Known prior art padded luggage include U. S. Pat. Nos. 4,801,213; 5,195,620; 4,273,223; 3,125,198; 556,526; and Foreign Patents EP 0 499 014 A1 and WO 91/17375.

In these respects, the inflatable luggage insert according to the present invention substantially departs from the conventional concepts and designs of the prior art, and in so doing provides an apparatus primarily developed for the purpose of preventing items within a piece of luggage from shifting during travel.

SUMMARY OF THE INVENTION

In view of the foregoing disadvantages inherent in the known types of padded luggage now present in the prior art, the present invention provides a new inflatable luggage insert construction wherein the same can be utilized for preventing items within a piece of luggage from shifting during travel.

The general purpose of the present invention, which will be described subsequently in greater detail, is to provide a new inflatable luggage insert apparatus and method which has many of the advantages of the padded luggage mentioned heretofore and many novel features that result in a new inflatable luggage insert which is not anticipated, rendered obvious, suggested, or even implied by any of the prior art padded luggage, either alone or in any combination thereof.

To attain this, the present invention is adapted for use with a suitcase or other type of luggage with a pair of halves. Each half is defined by a planar face and a rectangular peripheral side wall integrally coupled to a periphery of the planar face and extending therefrom. As such, an interior space and an open face is defined. Bottoms of the peripheral side walls of the halves are hingably coupled. Note FIGS. 4 & 5. The present invention includes a pair of bladders each including a rectangular frame defined by a top strip, a bottom strip and a pair of side strips. Each strip has a thin planar rectangular configuration and further resides in a common plane. As shown in FIG. 2, each bladder further includes a pair of sheets each constructed from a thin flexible material. Each sheet has a surface area greater than that encompassed by the frame. Each sheet also has a periphery which is integrally coupled to an inner edge of the rectangular frame. Together, the sheets form a hermetically sealed interior space. In use, each bladder has a collapsed deflated orientation and a taut inflated orientation. When taut, the bladder forms a pair of expanded side portions which define an apex and tapers inwardly toward the frame. As shown in FIG. 3, an adhesive is situated along an entirety of one of the faces of each strip of the frame. The adhesive of each strip has a removable waxed paper lining. When the paper lining is removed, the frame is secured to a periphery of an interior surface of one of the planar faces of the suitcase. For selectively inflating and deflating the interior space of the associated bladder, a valve is mounted on one of the sheets of each bladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable luggage insert apparatus and method which has many of the advantages of the padded luggage mentioned heretofore and many novel features that result in a new inflatable luggage insert which is not anticipated, rendered obvious, suggested, or even implied by any of the prior art padded luggage, either alone or in any combination thereof.

It is another object of the present invention to provide a new inflatable luggage insert which may be easily and efficiently manufactured and marketed.

It is a further object of the present invention to provide a new inflatable luggage insert which is of a durable and reliable construction.

An even further object of the present invention is to provide a new inflatable luggage insert which is susceptible of a low cost of manufacture with regard to both materials and labor, and which accordingly is then susceptible of low prices of sale to the consuming public, thereby making such inflatable luggage insert economically available to the buying public.

Still yet another object of the present invention is to provide a new inflatable luggage insert which provides in the apparatuses and methods of the prior art some of the advantages thereof, while simultaneously overcoming some of the disadvantages normally associated therewith.

Still another object of the present invention is to provide a new inflatable luggage insert for preventing items within a piece of luggage from shifting during travel.

Even still another object of the present invention is to provide a new inflatable luggage insert that includes at least one bladder having a periphery which encompasses an area approximately equal to one of a pair of faces of the piece of luggage. A valve is mounted on the bladder for selectively inflating the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
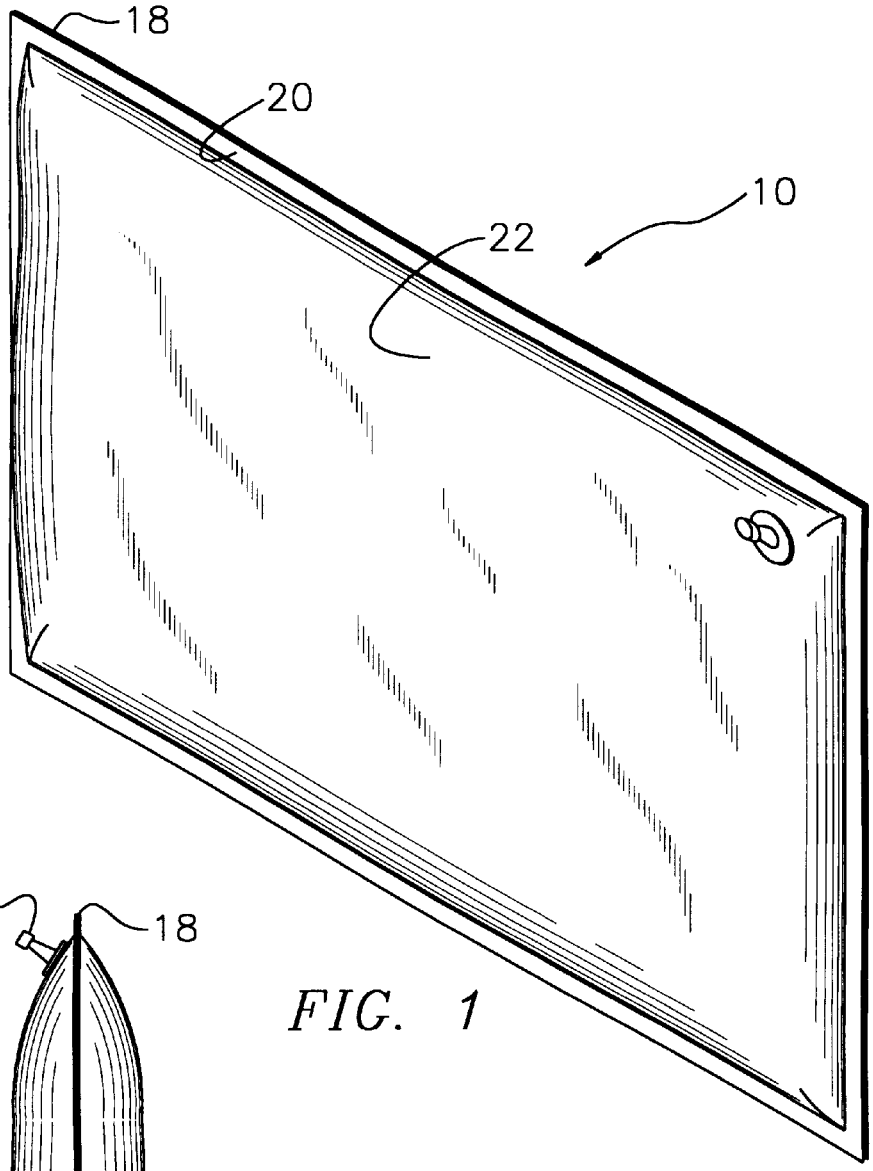
FIG. 1 is a perspective view of a new inflatable luggage insert according to the present invention.

With reference now to the drawings, and in particular to FIGS. 1 through 6 thereof, a new inflatable luggage insert embodying the principles and concepts of the present invention and generally designated by the reference numeral 10 will be described.

The present invention, designated as numeral 10, is adapted for use with a suitcase 12 or any other type of luggage with a pair of halves 14. Each half is defined by a planar face and a rectangular peripheral side wall integrally coupled to a periphery of the planar face and extending therefrom. As such, an interior space and an open face is defined. Bottoms of the peripheral side walls of the halves are hingably coupled. Note FIGS. 4 & 5.

The present invention includes a pair of bladders 18 each having a rigid rectangular frame 20 defined by a top strip, a bottom strip and a pair of side strips. Each strip has a thin planar rectangular configuration and further resides in a common plane. For reasons that will soon become apparent, a periphery of the frame encompasses an area approximately equal to one of the generally planar faces of the piece of luggage.

Figure 2:
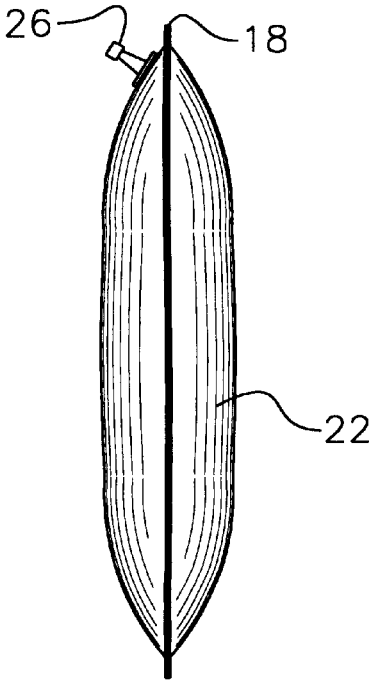
FIG. 2 is a side view of the present invention.

As shown in FIG. 2, each bladder further includes a pair of sheets 22 each constructed from a thin flexible material. Each sheet has a surface area greater than that encompassed by the frame. Each sheet also has a periphery which is integrally coupled to an inner edge of the rectangular frame. Together, the sheets form a hermetically sealed interior space.

Figure 4:
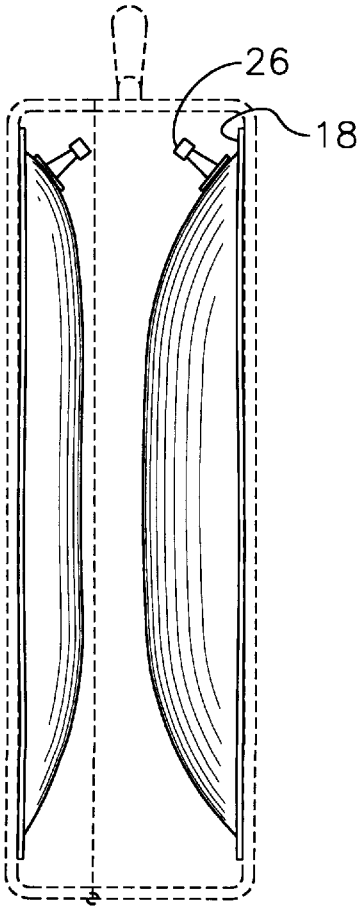
FIG. 4 is a side view of a first embodiment of the present invention.

In use, each bladder has a collapsed deflated orientation and a taut inflated orientation. When taut, the bladder forms a pair of expanded side portions which define an apex. The bladder also tapers inwardly in a smooth manner toward the frame. As shown in FIG. 4, each sheet of the bladder is capable of encompassing a volume which is about ¼ that of the piece of luggage when fully inflated.

Figure 3:
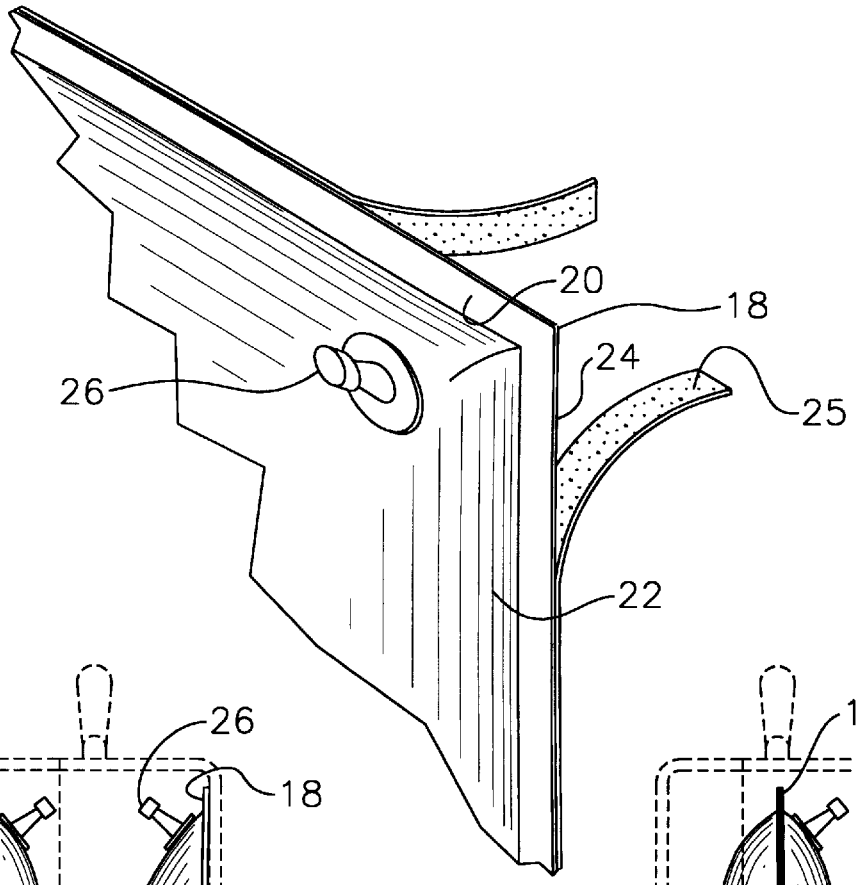
FIG. 3 is a detailed perspective view of the present invention showing the removable waxed paper strips.
Figure 5:
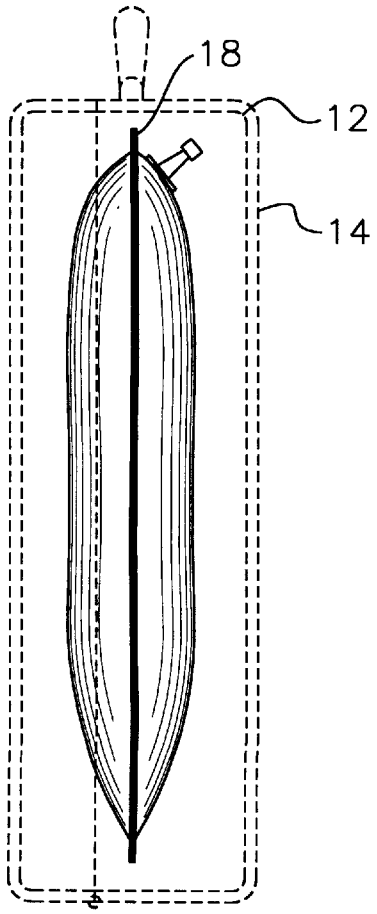
FIG. 5 is a side view of a second embodiment of the present invention.
Figure 6:
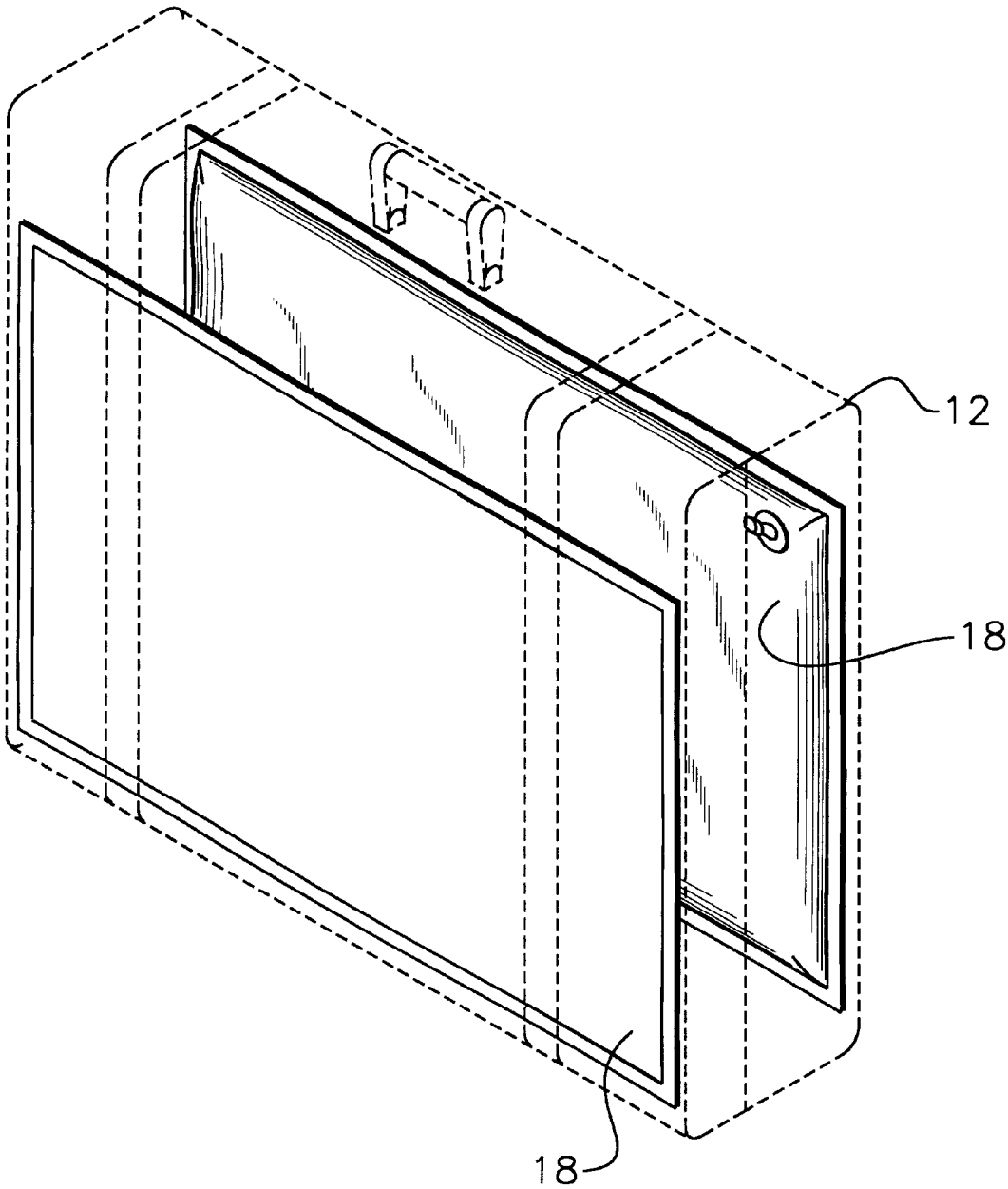
FIG. 6 is a perspective view of the present invention in use.

As shown in FIG. 3, an adhesive 24 is situated along an entirety of one of the faces of each strip of the frame. The adhesive of each strip has a removable waxed paper lining 25. When the paper lining is removed, the frame is secured to a periphery of an interior surface of one of the planar faces of the suitcase. As shown in FIG. 4, a pair of bladders are mounted on opposed halves of the piece of luggage. In an alternate embodiment, shown in FIG. 5, a single bladder may be employed which simply resides without constraint within the piece of luggage. In the embodiment of FIG. 5, the paper backing may be left intact for precluding the exposure of the adhesive.

For selectively inflating and deflating the interior space of the associated bladder, a valve 26 is mounted on one of the sheets of each bladder. It is imperative that the valve extends from a side of the frame opposite the adhesive. The valve preferably has a tubular configuration with an inboard end mounted on the associated bladder. The valve may be equipped with a flap hingably mounted therein by way of a living hinge. By this structure, each bladder may be inflated by blowing air into the valve. Further, each bladder may be deflated by simply squeezing the valve which in turn opens the flap. In use, the bladder or bladders may be inflated to a desired size which is sufficient to prevent cargo within the piece of luggage from shifting during travel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cargo constraining device for a suitcase comprising, in combination:

a suitcase including a pair of halves each defined by a planar face and a rectangular peripheral side wall integrally coupled to a periphery of the planar face and extending therefrom to define an interior space and an open face, wherein bottoms of the peripheral side walls of the halves are hingably coupled;

a pair of bladders each including a rectangular frame defined by a top strip, a bottom strip and a pair of side strips each having a thin planar rectangular configuration wherein the strips each reside in a common plane, each bladder further including a pair of sheets each constructed from a thin flexible material and each having a surface area greater than that encompassed by the frame, each sheet having a periphery which is integrally coupled to an inner edge of the rectangular frame for defining a hermetically sealed interior space therebetween, each bladder having a collapsed deflated orientation and a taut inflated orientation for defining a pair of expanded side portions which define an apex and tapers inwardly toward the frame;

adhesive mounted along an entirety of one of the faces of each strip of the frame, wherein the adhesive of each strip has a removable waxed paper lining for being removed such that the frame is secured to a periphery of an interior surface of one of the planar faces of the suitcase; and a valve mounted on one of the sheets of each bladder and extending from a side of the frame opposite the adhesive for selectively inflating and deflating the interior space of the associated bladder.

2. A cargo constraining system comprising:

a pair of bladders each including a frame defined by a top strip, a bottom strip and a pair of side strips, wherein the strips each reside in a common plane, each bladder further including a pair of sheets each constructed from a flexible material, each sheet having a periphery which is integrally coupled to an inner edge of the frame for defining a hermetically sealed interior space between the sheets, each bladder having a collapsed deflated orientation and an inflated orientation;

adhesive on a face of each strip of each of the frames for securing the frames of the bladders to an interior surface of a suitcase, wherein the adhesive of each strip has a removable lining; and a valve mounted on one of the sheets of each bladder and extending from a side of the bladder opposite a side of the bladder having the adhesive for selectively inflating and deflating the interior space of the associated bladder.

3. The cargo constraining system of claim 2 additionally comprising a suitcase including a pair of halves each defined by a planar face and a substantially rectangular peripheral side wall coupled to a periphery of the planar face, the peripheral side wall extending therefrom to define an interior space and an open face, wherein bottoms of the peripheral side walls of the halves are hingably coupled.

* * * * *